US007473874B2

(12) United States Patent
Carlsson et al.

(10) Patent No.: US 7,473,874 B2
(45) Date of Patent: Jan. 6, 2009

(54) ACCESSORY FOR DOMESTIC MICROWAVE OVENS

(75) Inventors: Hakan Carlsson, Norrkoping (SE); Ricardo Garcia-Padron, Linkoping (SE); Vivian Sandman, Norrkoping (SE); Fredrik Hallgren, Kolmarden (SE)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 11/553,112

(22) Filed: Oct. 26, 2006

(65) Prior Publication Data

US 2007/0095824 A1 May 3, 2007

(30) Foreign Application Priority Data

Oct. 26, 2005 (EP) ..... 05110047

(51) Int. Cl.
*H05B 6/80* (2006.01)

(52) U.S. Cl. ..... 219/730; 219/725; 219/727

(58) Field of Classification Search ..... 219/728–735, 219/744, 756, 757, 762, 763, 753; 426/107, 426/234, 241–243; 99/DIG. 14
See application file for complete search history.

(56) References Cited

U.S. PATENT DOCUMENTS 2,830,162 A 4/1958 Copson et al.
4,210,124 A 7/1980 Husslein et al.
4,478,349 A * 10/1984 Haverland et al. ..... 220/573.4
4,496,815 A * 1/1985 Jorgensen ..... 219/730
4,663,506 A * 5/1987 Bowen et al. ..... 219/730
4,992,638 A 2/1991 Hewitt et al.
5,247,149 A * 9/1993 Peleg ..... 219/729
5,396,052 A * 3/1995 Petcavich et al. ..... 219/725
6,307,193 B1 * 10/2001 Toole ..... 219/735
6,847,021 B2 * 1/2005 Lefeuvre et al. ..... 219/730

FOREIGN PATENT DOCUMENTS

EP 0240235 A2 10/1987

* cited by examiner

*Primary Examiner*—Tu B Hoang
*Assistant Examiner*—Vinod D Patel
(74) *Attorney, Agent, or Firm*—John Morrison; Michael D. Lafrenz

(57) ABSTRACT

The present invention relates to a browning accessory for use in a microwave oven, for substantially simultaneous microwave cooking and browning or crusting of a food item. The browning accessory includes a microwave absorbing material operative to convert microwave energy into thermal energy and having its underside uncovered, thereby being accessible to airflow inside the microwave oven, and an outer enclosure having a skirt portion extending downwards below the microwave absorbing material to reduce convection cooling of the microwave absorbing material during use of the accessory.

10 Claims, 2 Drawing Sheets

ACCESSORY FOR DOMESTIC MICROWAVE OVENS

BACKGROUND OF THE INVENTION

1. Field of the Invention

The present invention relates to accessories for domestic microwave ovens. Above all, the present invention relates to browning accessories which are used during microwave cooking for providing a food item with a crispy or browned surface.

2. Description of the Related Art

Some current microwave ovens have an extra feature in the form of a grill or a browning device incorporated into the oven. Typically, this browning device is mounted in the ceiling of the microwave cavity in order to direct radiant heat toward the food item being cooked. However, other types of microwave ovens do not present this feature. For this latter kind of microwave oven, there may be offered other accessories for providing a browning effect for a food item.

It is known in the art of domestic microwave ovens to use microwave absorbing materials for providing a heated surface that, when subjected to microwave energy, attains a temperature suitable for crisping or browning a food item simultaneously with the microwave cooking.

One example is given in U.S. Pat. No. 2,830,162 wherein a cooking utensil is disclosed, comprising a ferromagnetic-like material that reaches a certain temperature during use.

SUMMARY OF THE INVENTION

Generally, it would be desirable to have a browning accessory adapted for contact-free browning of a food item while the food item at the same time may undergo microwave cooking. It would also be desirable to have a browning accessory that may conveniently be removed by a user after or during cooking without any uncomfortable heat sensation. This browning accessory should also be reusable, and be based on a principle that may be used under various conditions and in various types of microwave ovens.

For this reason, there is a need in the art of domestic microwave ovens for an improved and reusable browning accessory which provides predictable and acceptable cooking results in various kinds of microwave ovens, and which adds convenience to a prospective user.

The present invention provides a reusable article in the form of a browning accessory according to the appended claims.

Consequently, the article according to the invention comprises an outer enclosure with a skirt portion, protecting the microwave absorbing material from convection cooling during use.

By having the skirt of the enclosure extending downward below the microwave absorbing material and over part of the vertical dimension of the food item or the packaging in which it is contained, a quantity of warm air will develop adjacent the underside of the browning accessory, thus improving the browning effect and reducing convection cooling which could impair the crusting or browning capability. According to one embodiment, by having a cover above the microwave absorbing material, air streams over the upper side of the microwave absorbing material are eliminated or reduced, leading again to a reduction of the conduction cooling of the browning accessory, and to improved operability.

The microwave absorbing material is provided on a carrier structure, designed to provide mechanical stability. It may be a frame-like structure from which the microwave absorbing material is suspended, or it may have the form of a substrate plate where the microwave absorbing material is provided on one surface.

Further, the carrier structure is designed to direct the microwave field such that the microwave absorbing material will generate thermal energy in an efficient manner. The carrier structure may be made from electrically conductive materials, or from dielectric materials.

Advantageously, the enclosure is made from a rigid, microwave transparent material distanced from the microwave absorbing material. By having the enclosure distanced from the browning area, the heating of the enclosure will be minimal during use, since the temperature rise is mainly isolated to the microwave absorbing material. Thus, the article may be gripped and handled by a user immediately after use without the occurrence of uncomfortable sensations of heat. It will also be possible for the user to intermittently interrupt the cooking, and to lift the browning accessory and check whether the food item has obtained a desired crust or browned surface, and to continue the cooking if this is not the case.

The microwave absorbing material may be a ferrite/rubber based composite, optionally with a thin layer of metal oxide. The use of ferrite materials in a microwave oven is known in the art, and typically has the purpose of converting microwave energy into thermal energy through magnetic losses in the material. One distinguishing characteristic of ferrite materials is the Curie temperature; the temperature at which the material starts to lose its magnetic properties. When the Curie temperature is reached, the absorption of microwave energy ceases and further heating is prevented. By selecting the Curie temperature of the ferrite material, it is thereby possible to predetermine the operating temperature of the microwave absorbing material.

According to one aspect of the present invention, the operating temperature of the microwave absorbing material should typically be in the range of 200-400° C., for example around 300° C.

BRIEF DESCRIPTION OF THE DRAWINGS

In the following detailed description of the preferred embodiment, reference is made to the accompanying drawings, on which.

DETAILED DESCRIPTION OF THE PREFFERED EMBODIMENTS

A preferred embodiment of the inventive browning accessory will now be described with reference to the accompanying drawings. It should be noted that the drawings are given merely as an illustrative example, and should not be construed as being limiting for the scope of protection sought. After having read and understood the present description, a person of ordinary skill in the relevant art will appreciate that there are various modifications that can be made without departing from the scope as defined in the appended claims.

Accordingly, the inventive accessory may be placed in a microwave oven by a prospective used as desired when a browned or crusted surface on the food being cooked is sought.

The main elements of the inventive browning accessory 10 is the microwave absorbing material 12 and the outer enclosure 14. The outer enclosure has a skirt portion 14*b*, extending downward below the microwave absorbing material 12. During use of the accessory 10, the microwave absorbing material provides a browning area located over a food item 16 to be cooked.

Figure 1:
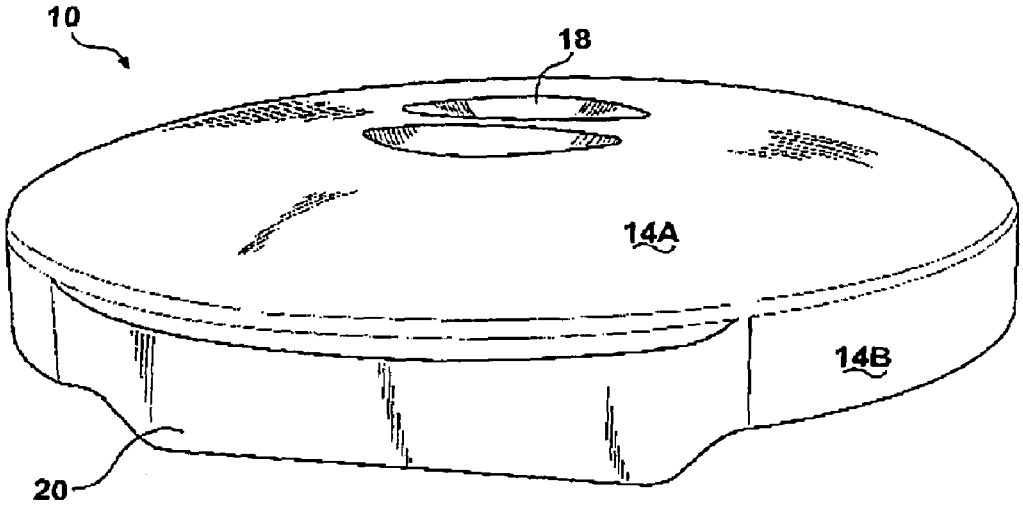
FIG. 1 is a perspective view showing the outer enclosure and the overall design of a preferred embodiment according to the invention.

The outer enclosure 14 of the browning accessory 10, one embodiment of which is shown in FIG. 1, is made from an integral piece of microwave transparent material, such as plastic, glass or ceramic. The enclosure features an upper surface or enclosure 14*a*, which may be provided with recesses 18 or the like to facilitate for the user when gripping the article. The enclosure 14 is also provided with a skirt portion 14*b*, or curtain, extending downward below the browning area, and projecting beyond the microwave absorbing material 12 fitted in the enclosure 14. Additional aspects of this skirt portion will be explained in more detail below.

The enclosure 14 also exhibits a pair of legs or leg-like structures 20, extending from or adjacent to the skirt portion 14*b*. These legs 20 are designed to rest against the bottom wall (floor) of a microwave oven during cooking. An advantageous effect of having the legs 20 extending further downward from the skirt portion 14*b* is that there will be a separation between this skirt portion of the browning accessory 10 and the bottom wall of the microwave oven, through which there is open communication to the outside of the enclosure 14. In this manner, build-up of pressure under the browning accessory is eliminated. Moisture developed during cooking may be effectively removed from underneath the browning accessory. The effect of excess moisture over the food surface may deteriorate the browning effect.

The outer enclosure 14 has a generally circular, disc-like shape as viewed in a vertical plan view in the operating position. Such shape will maximize the area under the browning area, while at the same time permitting rotation upon a turn table, often found in domestic microwave ovens. Additionally, the upper side of the outer enclosure 14 is generally convex, as schematically illustrated in the drawings. The inventive browning accessory 10 may also conveniently be shaped such that it conforms to the shape of a typical or a dedicated food container 16. It should be understood, however, that any other shape may be preferred depending on the targeted use.

Figure 4:
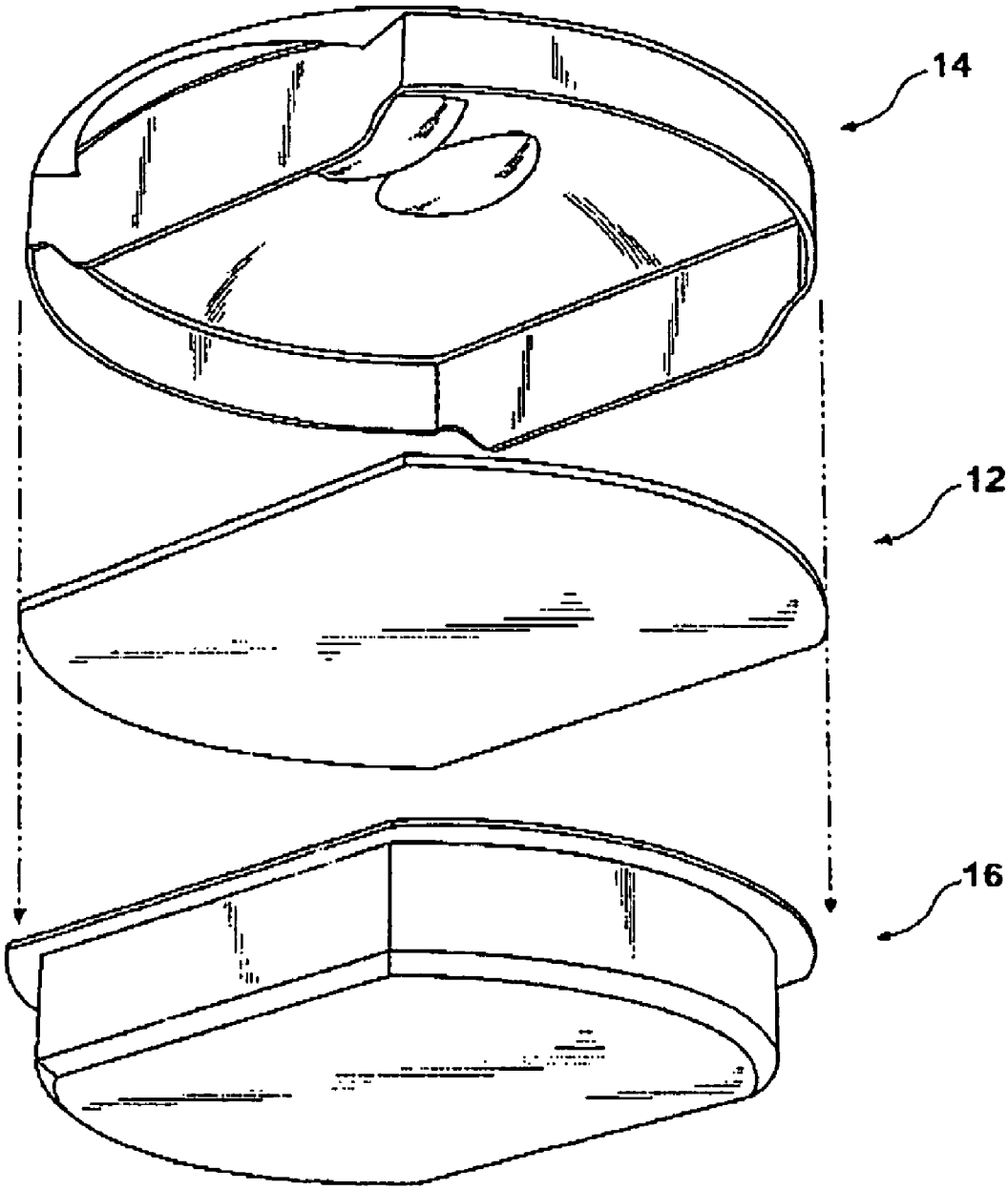
FIG. 4 is a perspective view from underneath the inventive accessory, showing the position of the browning area and a food item container.

As best seen in the bottom view of the browning device of FIG. 4, the skirt portion 14*b* may have straight portions (much like a chord of the circular outer shape) or otherwise modified portions, providing additional gripping means at the rim of the upper surface 14*a*. Depending on the kind of microwave oven in which the article is used, different gripping methods may be desired by the user.

Within the outer enclosure 14, there is a carrier structure upon which the microwave absorbing material 12 is mounted, defining a browning area for the accessory 10. The microwave absorbing material 12 with its carrier is typically a flat piece mounted to the skirt portion 14*b*. Between the microwave absorbing material 12 and the upper enclosure cover 14*a*, there is an air gap 22, effectively isolating the upper surface of the enclosure from the browning area defined by the microwave absorbing material. In this aspect, the user may grip the article immediately after a cooking procedure without feeling any uncomfortable sensation of heat in his or her fingers. The air gap 22 is conveniently made sufficiently large by having the upper surface of the enclosure convex, e.g. domeshaped.

Figure 2:
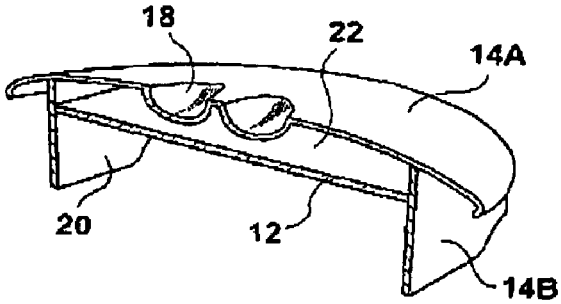
FIG. 2 is a perspective view in cross-section of the embodiment shown in FIG. 1, showing in more detail the inventive features.
Figure 3:
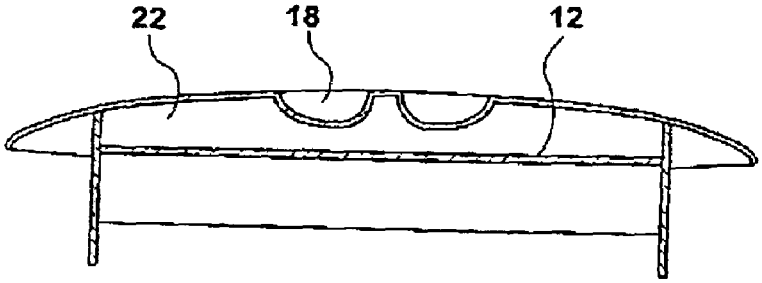
FIG. 3 is a plan view in cross-section, similar to the view shown in FIG. 2.

The shape of the enclosure 14, with the upper cover 14*a* and the skirt portion 14*b*, is shown in cross section in FIGS. 2 and 3. The air gap 22 between the microwave absorbing material 12 and the upper cover 14*a* of the enclosure is clearly evident.

The skirt portion 14*b* of the enclosure prevents loss of heat due to convection of air across the browning area 12. The skirt 14*b* provides shelter for the browning area 12 from any convection that may be present inside the microwave oven cavity. For the preferred embodiment having also an upper cover, and as seen from the drawings, the browning area 12 is only freely exposed downwards during use. This means that the only surface of the browning area 12 that is accessible by air flows inside the microwave oven is its underside. However, this underside is surrounded by the skirt portion 14*b* of the outer enclosure, meaning that a cushion of heated air will develop during use. Effectively, the browning area of the inventive accessory is shielded from convection cooling, leading to improved browning capabilities. The skirt portion 14*b* aids in directing the heat from the browning area 12 towards the food item 16 over which the inventive accessory 10 is placed.

The skirt portion 14*b* may also provide protection from splatter from the food item 16, due to boiling liquid or fat, during cooking.

The dimensions of the browning accessory 10 may be freely adapted for any particular use, e.g. for a particular type of microwave oven, or for a particular type of food packaging. However, the accessory may also be provided with general dimensions that are suitable for various situations.

An exemplary article in the form of a browning accessory for use in a microwave oven may have a circular shape of diameter about 260 mm. Such dimension will be suitable for most types of domestic microwave ovens currently available. The total height of the article, from the resting portion of the legs to the top portion of the convex upper surface of the enclosure, may be up to about 100 mm or more. The vertical placement of the microwave absorbing material within the microwave oven cavity affect the heating of the material. Thus, the length of the legs for the browning accessory, indirectly determining the vertical placement of the microwave absorbing element, may be tailor made for some types of microwave ovens. However, the accessory may be designed for general use, wherein the height is selected such that is provides a satisfactory result for a large number of different oven types. Additionally, the browning effect will to some degree depend upon the distance between the browning area and the upper surface of the food item to be cooked.

Preferred materials for the browning accessory are as follows. The microwave absorbing material constituting the browning area may comprise a ferrite/rubber composite of the kind currently used in browning plates for microwave ovens. Alternatively, the microwave absorbing material may comprise a layer of metal oxide, per se known in the art. Combinations of these types of materials are also conceivable. The material should be selected and designed such that the browning area attains a temperature in the range of about 200-400° C., for example about 300° C. during use. However, it should be noted that other operating temperatures may be desired in some embodiments.

The carrier structure supporting the microwave absorbing material may comprise an electrically conductive material (such as aluminum) or a dielectric material (such as glass-ceramic), and may take the form of a frame or a plate. A person of ordinary skill in the relevant art will realize that there are various designs that may be applied in order to obtain a desired functionality. For example, the carrier structure may be designed such that the microwave field is directed in a manner to heat the microwave absorbing material as quickly as possible during use.

The outer enclosure, including the upper cover and the skirt portion (and possibly also the legs extending therefrom), may conveniently be made from a microwave transparent material, such as plastic, glass or ceramic.

While the invention has been specifically described in connection with certain specific embodiments thereof, it is to be understood that this is by way of illustration and not of limitation, and the scope of the appended claims should be construed as broadly as the prior art will permit.

The invention claimed is:

1. A browning accessory for use in a microwave oven, for substantially simultaneous microwave cooking of a food item and browning or crusting the upper side thereof, the browning accessory comprising:

a microwave absorbing material operative to convert microwave energy into thermal energy and having its underside uncovered, thereby being accessible to airflow inside the microwave oven; and an outer enclosure comprising:

a non-vented cover over the upper side of the microwave absorbing material and configured to completely overlie the food item;

a peripheral skirt portion extending downward from the cover to substantially surround the food item and having a lower edge located below the microwave absorbing material, in the working position of the accessory, to reduce convection cooling of the microwave absorbing material during use of the accessory; and legs extending from the skirt portion and having a lower edge upon which the accessory rests in the working position and located below the lower edge of the skirt portion to separate the lower edge of the skirt portion from the surface upon which the accessory rests, thereby defining at least one vent between the lower edge of the skirt portion and the lower edge of the legs.

2. The accessory according to claim 1, wherein the cover is separated from the microwave absorbing material by an air gap providing thermal insulation for the cover.

3. The accessory according to claim 1, wherein the outer enclosure is made from a non-microwave absorbing material.

4. The accessory according to claim 1, wherein the microwave absorbing material is adapted to attain a temperature during use in the range of about 200-400° C.

5. The accessory according to claim 1, further comprising a handle to facilitate positioning the accessory before and after cooking.

6. The accessory according to claim 1, wherein the microwave absorbing material comprises a ferrite/rubber composite.

7. The accessory according to claim 1, wherein the outer enclosure, including the upper cover and the skirt portion, is comprised of an integrally formed piece.

8. The accessory according to claim 1, wherein the microwave absorbing material is provided on a carrier structure, and wherein the carrier structure is attached within the outer enclosure.

9. The accessory according to claim 8, wherein the carrier structure is operative to direct the microwave field during use in order to improve the absorption of microwave energy in the microwave absorbing material.

10. The accessory according to claim 8, wherein the accessory has a shape and size specifically designed for a dedicated food package.

* * * * *